US006192848B1

(12) United States Patent
Hada et al.

(10) Patent No.: US 6,192,848 B1
(45) Date of Patent: Feb. 27, 2001

(54) INTAKE MANIFOLD

(75) Inventors: Masatoshi Hada, Nagoya; Yoshinori Hayasaka, Koga, both of (JP)

(73) Assignees: Aichi Kikai Kogyo Kabushiki Kaisha, Nagoya; Sanoh Kogyo Kabushiki Kaisha, Koga, both of (JP)

( * ) Notice: Subject to any disclaimer, the term of this patent is extended or adjusted under 35 U.S.C. 154(b) by 0 days.

(21) Appl. No.: 09/482,325

(22) Filed: Jan. 14, 2000

(30) Foreign Application Priority Data

Jan. 27, 1999 (JP) ..... 11-019056

(51) Int. Cl.[7] ..... F02M 35/10
(52) U.S. Cl. ..... 123/184.24; 123/572
(58) Field of Search ..... 123/184.24, 184.42, 123/184.34, 184.47, 572, 573, 574, 41.86

(56) References Cited

U.S. PATENT DOCUMENTS 4,790,287 * 12/1988 Sakurai et al. ..... 123/41.86
6,009,863 * 1/2000 Tochizawa ..... 123/184.47
6,089,199 * 7/2000 Lohr et al. ..... 123/184.47

* cited by examiner

*Primary Examiner*—Marguerite McMahon
(74) *Attorney, Agent, or Firm*—Dennison, Scheiner, Schultz & Wakeman

(57) ABSTRACT

An intake manifold is provided in which blow-by gas is distributed uniformly and readily to the cylinders of an engine. The intake manifold 10 is made of aluminum and has a blow-by gas passage 14 formed integral with a collector 11 as ridged on the collector 11 and located adjacent to the proximal ends of intake manifolds 12*a*,12*b*, 12*c*, and 12*d*, which are mounted vertically of the collector 11, to extend at a right angle to the axes of the intake manifolds 12. Mounting rings 20 are provided next to the ridged block-by gas passage 14 for accepting the proximal ends of the intake tubes 12.

4 Claims, 3 Drawing Sheets

INTAKE MANIFOLD

BACKGROUND OF THE INVENTION

1. Field of the Invention

The present invention relates to an intake manifold for a multi-cylinder engine and particularly, to an improvement in a structure of blow-by-gas passage in the same.

2. Description of the Related Art

A known intake manifold for a multi-cylinder engine is designed such that intake tubes are bound to groups or a single bundle to avoid interference between intake air flows and to distribute the air-flows uniformly.

Such a conventional intake manifold 1 comprises, as shown in FIG. 5, a collector 2 formed by aluminum die casting, a plurality of intake tubes 3 made of aluminum pipes, and an intake tube mount 4 formed by aluminum die casting for fixedly mounting the intake tubes 3 to the engine. The intake tubes 3 are bent to desired shapes and joined to the collector 2 and the intake tube mount 4. One end of the collector 2 is connected to a blow-by gas tube 5. when the cylinders are negatively pressurized, The blow-by gas tube 5 serves to feed back to the engine a mist of blow-by gas (oil mist) which has leaked through gaps at the piston rings to the crank case and contains some lubricant oil (and thus should not be discharged directly to the outside). The blow-by gas from the blow-by gas tube 5 is fed via an inner space 6 in the collector 2 to the intake tubes 3 as shown in FIG. 6.

Another type of a known intake manifold has a structure shown in FIGS. 7 and 8, in which a communicating tube 7 communicates with the intake tubes 3 and is mounted as a branch to intermediate portions of the intake tube 3 for taking a blow-by gas via a tube 8 from the engine. The intake tubes 3 and the communicating tube 7 are made of cast iron. The communicating tube 7 is joined to the intake tubes 3 by pipes 9.

The first known type of intake manifold 1 discussed above permits the single blow-by gas tube 5 to be connected to the inner space 6 of a considerable size to which the intake tubes 3 are also connected. This may cause blow-by gas to flow mostly into some of the intake tubes 3 located adjacent to the blow-by gas tube 5. Therefore, only a small amount of blow-by gas flows into the other intake tubes 3 located far from the blow-by gas tube 5, hence hardly providing uniform distribution of the blow-by gas to the intake tubes 3. If the intake manifold 1 includes pipes each connected to their respective intake tube 3 for distributing the blow-by gas uniformly, its construction will be intricate thus increasing the cost.

The second known type of the intake manifold has the communicating tube 7 mounted to the intermediate portions of the intake tubes 3 and is complicated in the structure. Also, because the communicating tube 7 is joined by the intake tubes 3 by the pipes 9, measures against vibration of the pipes 9 are needed.

SUMMARY OF THE INVENTION

The present invention is intended to eliminate the foregoing problems and its object is to provide an intake manifold capable of distributing blow-by gas to the intake tubes uniformly and easily with the use of a simple construction and without accounting for measures against vibration.

According to the present invention, an intake manifold having a collector and a plurality of intake tubes connected to the collector for feeding intake air to corresponding cylinders of an engine comprises a blow-by gas passage formed integral with the surface of the collector adjacent to the proximal ends of the intake tubes where the intake tubes are connected to the collector. Through apertures are formed in both sides of the blow-by gas passage for communicating the blow-by gas passage with the proximal ends of the intake tubes, thus eliminating the foregoing problems.

Thus, the intake manifold according to the present invention has the blow-gas passage formed on the surface of the collector and provided with the through apertures to communicate with the intake tubes, whereby the through apertures can easily be machined for having desired cross section and direction. Accordingly, with a simple construction, the distribution of blow-by gas to the cylinders will be uniform due to the corresponding cross sections and directions of the through apertures. In particular, the blow-by gas passage in the intake manifold of the present invention is formed on the surface of the collector and is thus simple in the construction and requires no measures against vibration.

The blow-by gas passage may be ridged on the surface of the collector.

Also, the manifold may further comprise intake tube mounting rings formed upright on the surface of the collector adjacent to the blow-by gas passage so that the inside of the proximal ends of the intake tubes fitted into the intake tube mounting rings communicates with the through apertures.

Moreover, it may be arranged that the intake tubes are connected to the collector so that their axes extend across two substantially parallel straight lines and the blow-by gas passage is arranged to extend in parallel to and between the two straight lines and connected at both sides to the intake tubes.

PREFERRED EMBODIMENT OF THE INVENTION

One embodiment of an intake manifold according to the present invention will be described with reference to FIGS. 1 to 4.

Figure 1:
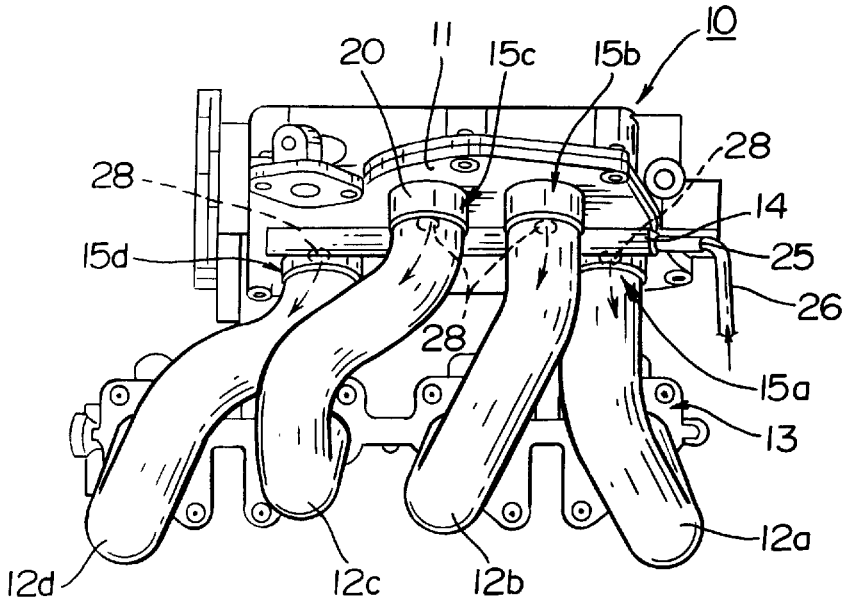
FIG. 1 is a plan view showing an embodiment of an intake manifold of the present invention.

An intake manifold 10 includes, as shown in FIG. 1, a collector 11 of aluminum die-casting, a plurality of (or four for description) intake tubes 12*a*, 12*b*, 12*c*, and 12*d* or branches made of aluminum pipes, an intake manifold mount 13 formed by aluminum die-casting, and a blow-by gas passage 14 formed integral with the collector 11 which is a primary feature of the present invention.

Figure 3:
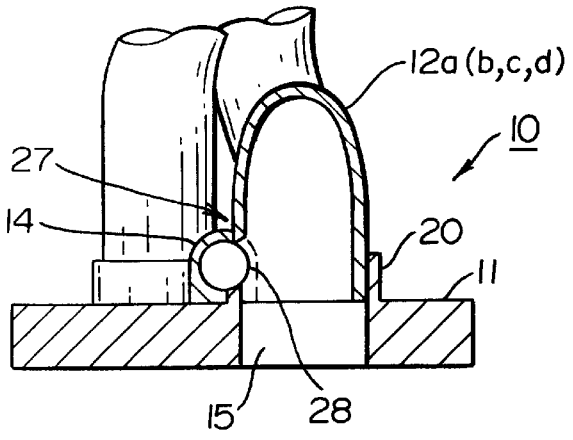
FIG. 3 is a cross sectional view showing an arrangement of the intake tubes and the blow-by gas passage.

The collector 11 generally has a sheet-like shape and includes bores 15*a* to 15*d*, the number of which is the same as the intake tubes 12*a* to 12*d* and the diameter of which is adapted to match the outer diameter of the intake tubes 12*a* to 12*d* as shown in FIG. 3. The bores 15*a* to 15*d* are arranged with the first bore 15*a* and the fourth bore 15*d* centering across a common line and the second bore 15*b* and the third bore 15*c* centering across a common line. The two common lines extend in substantially parallel to each other. Each of the bores 15*a* to 15*d* is accompanied at one end with an intake tube mounting ring 20 that is in an upright position and integral with the collector 11. The intake tubes 12*a* to 12*d* are closely fitted into the intake tube mounting rings 20.

Figure 2:
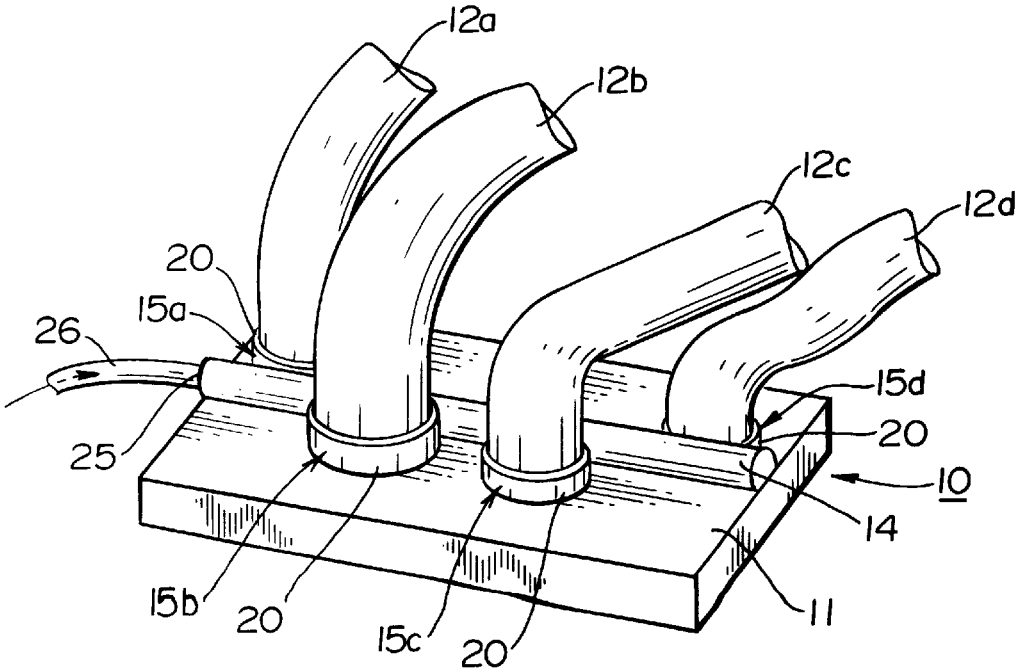
FIG. 2 is a perspective view showing a layout of a collector, intake tubes, and a blow-by gas passage.

The intake tubes 12*a* to 12*d* are bent or curved to such shapes as illustrated in FIGS. 1 and 2 and are fixedly fitted at one end into the intake tube mounting rings 20 and fixedly joined at the other end to the intake tube mount 13.

Figure 4:
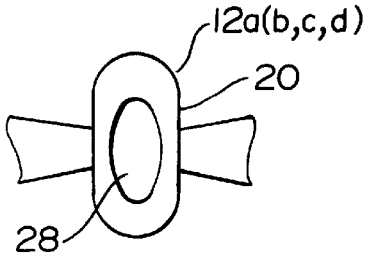
FIG. 4 is a view showing through apertures provided in the intake tubes.
Figure 5:
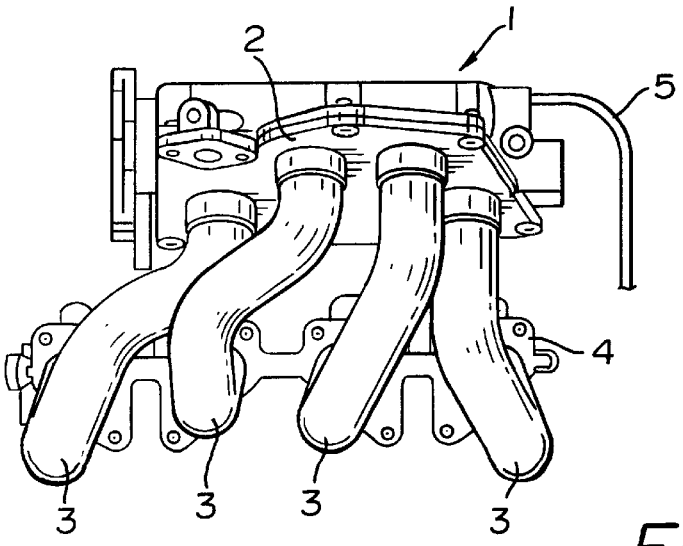
FIG. 5 (PRIOR ART)
FIG. 5 is a plan view of a known intake manifold.
Figure 6:
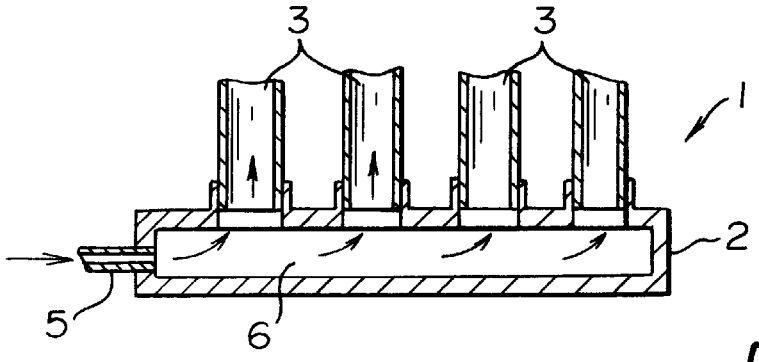
FIG. 6 (PRIOR ART)
FIG. 6 is an explanatory view showing the relation between the inner space of a collector and intake tubes shown in FIG. 5.
Figure 7:
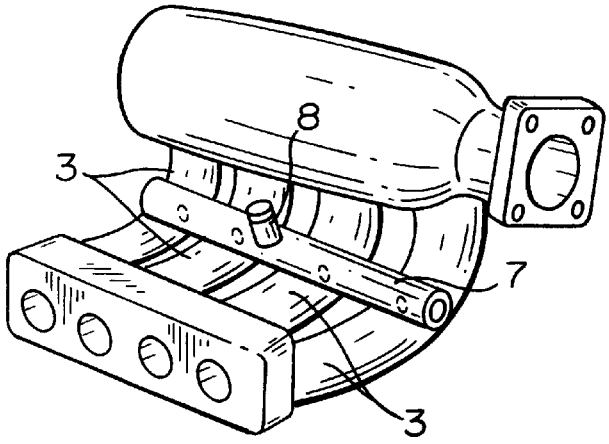
FIG. 7 (PRIOR ART)
FIG. 7 is a perspective view of another known intake manifold.
Figure 8:
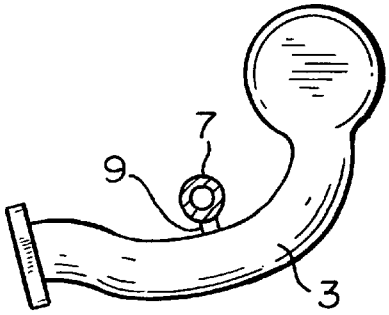
FIG. 8 (PRIOR ART)
FIG. 8 is a side view of the intake manifold shown in FIG. 7.

The blow-by gas passage 14 has a narrow, long tube-like shape, as shown in FIG. 2, extending between the common line of the first intake tube 12*a* and the fourth intake tube 12*d* and the common line of the second intake tube 12*b* and the third intake tube 12*c*. The blow-by gas passage 14 is formed integral with the collector 11 to be ridged on a surface of the collector 11 of a sheet-like shape. As best shown in FIG. 3, the blow-by gas passage 14 is a passage of a circular shape in the cross section (for example, 12 mm in diameter) and is closed at one end while having a gas inlet 25 at the other end to be connected to a blow-by gas pipe 26. The blow-by gas passage 14 is communicated to the intake tubes 12 by through apertures 28 (for example, of an oval shape of 6 mm×12 mm) provided in interface regions 27 between the blow-by gas passage 14 and the intake tube mounting rings 20 as shown in FIGS. 3 and 4. The through apertures 28 are machined to have suitable sizes and directions for providing uniform distribution of the blow-by gas to the cylinders of the engine. More particularly, the cross section of the through apertures 28 is smaller on the gas inlet 25 side but greater on the opposite side far from the gas inlet 25.

The intake manifold 10 is arranged such that blow-by gas passed through the pipe 26 and introduced from the gas inlet 25 to the blow-by gas passage 14 flows through the through apertures 28 that have suitable cross section and the direction. The blow-by gas then enters the intake tubes 12*a* to 12*d* uniformly before flowing into the cylinders, hence significantly improving the effectiveness of gas distribution to the cylinders.

Because the blow-by gas passage 14 is ridged on the collector surface, its sides are exposed and can thus be machined easily to have the through apertures 28 of different cross section and direction for achieving uniform distribution of the blow-by gas to the intake tubes 12. Also, the intake tube mounting rings 20 are formed upright in proximity to the blow-by gas passage 14, thus allowing the distribution of gas to the cylinders to be changed by either fitting the intake tubes 12 having desired apertures or notches provided in the proximal end thereof to match the through apertures 28 or adjusting the size of apertures or notches in the intake tubes 12.

What is claimed is:

1. An intake manifold having a collector and a plurality of intake tubes connected to the collector for feeding intake air to corresponding cylinders of an engine, comprising a blow-by gas passage formed integral with the surface of the collector adjacent to the proximal ends of the intake tubes where the intake tubes are connected to the collector and having through apertures provided in both sides thereof for communicating the blow-by gas passage with the proximal ends of the intake tubes.

2. An intake manifold according to claim 1, wherein the blow-by gas passage is ridged on the surface of the collector.

3. An intake manifold according to claim 2, further comprising intake tube mounting rings formed upright on the surface of the collector adjacent to the blow-by gas passage so that the inside of the proximal ends of the intake tubes fitted into the intake tube mounting rings communicates with the through apertures.

4. An intake manifold according to claim 1, wherein the intake tubes are connected to the collector so that their axes extend across two substantially parallel straight lines and the blow-by gas passage is arranged to extend in parallel to and between the two straight lines and connected at both sides to the intake tubes.

* * * * *